United States Patent [19]

Bayly

[11] Patent Number: 4,958,744

[45] Date of Patent: Sep. 25, 1990

[54] CONTAINER CLOSURE

[75] Inventor: Peter K. Bayly, Euroa, Australia

[73] Assignee: Kingsley Nominees Pty. Ltd., Blackburn, Australia

[21] Appl. No.: 336,054

[22] Filed: Apr. 11, 1989

[30] Foreign Application Priority Data

Apr. 12, 1988 [AU] Australia ..... PI7705

[51] Int. Cl.[5] ..... B65D 51/12

[52] U.S. Cl. ..... 220/305; 220/307; 215/320; 215/354

[58] Field of Search ..... 220/305, 307, DIG. 19; 215/246, 298, 320, 354, 355, 363, 364

[56] References Cited

U.S. PATENT DOCUMENTS

| | | | |
|---|---|---|---|
| 1,304,002 | 5/1919 | Watkins | 215/363 |
| 3,073,473 | 1/1963 | Davidson | 215/364 |
| 3,297,184 | 1/1967 | Andelin | 215/320 X |
| 3,298,415 | 1/1967 | Klygis | 215/320 X |
| 3,380,610 | 4/1968 | Krieps | 215/355 X |
| 3,415,405 | 12/1968 | Rausing et al. | 215/364 X |
| 3,756,480 | 9/1973 | Swett et al. | 220/305 X |
| 4,426,014 | 1/1984 | Coltman, Jr. | 220/307 |
| 4,537,325 | 8/1985 | Zieff | 220/305 X |
| 4,606,474 | 8/1986 | Dudzik | 220/307 |

*Primary Examiner*—Stephen Marcus
*Assistant Examiner*—Nova S. Tucker
*Attorney, Agent, or Firm*—Stevens, Davis, Miller & Mosher

[57] ABSTRACT

A closure for the open mouth of a container includes a main body and sealing means which extends around the periphery of the main body. The sealing means has a sealing edge which is adapted to engage a sealing surface formed on the container, and a resiliently flexible web which connects the sealing edge to the main body. The web is movable between a relaxed condition, in which the diameter of the sealing edge is at a maximum, and a sealing condition, in which the diameter of the sealing edge is less than maximum. When the closure operatively closes the opening in the container the web is moved to the sealing condition, and the resilience of the web material serves to press the sealing edge against the sealing surface. Preferably the web in its relaxed condition has a frusto-conical form which diverges upwardly and the sealing edge is formed on the upper and outer edge of the web.

13 Claims, 3 Drawing Sheets

CONTAINER CLOSURE

Figure 1:
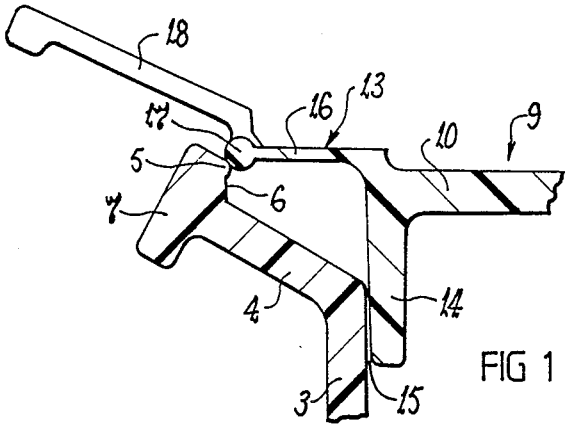

This invention relates to closures for containers and is particularly although not exclusively concerned with containers as used for the storage and/or cooking of food. It will be convenient to hereinafter describe the invention with particular reference to food containers, but it must be understood that there are other applications of the invention.

It is now conventional practice to manufacture food containers from plastics materials, and it is also common practice to employ the flexibility of such material in achieving a sealing relationship between the container body and a closure. A great variety of closure designs have been proposed in an attempt to achieve an effective closure to container body seal, and particularly such a seal which can be repeatedly broken and applied without deterioration. It has proven to be difficult, however, to produce a closure having the desired sealing qualities and which is also of relatively simple and inexpensive construction.

Another problem with many prior closures is their inability to properly function—i.e., seal—in various conditions of use. For example, a closure seal which is effective for refrigeration storage purposes is seldom effective when used in a high temperature environment such as cooking.

It is an object of the present invention to provide a container closure which is of relatively simple and inexpensive construction and which can be used repeatedly without deterioration of the sealing effectiveness of that closure. It is another object of the invention to provide such a closure which can be used effectively in various environments. Yet another object of the invention is to provide such a closure which can be applied and removed with relative ease.

According to the invention there is provided a closure for the open mouth of a container having an internal sealing surface which defines or is adjacent to the opening and against which said closure engages to close said opening, said closure comprising, a main body, sealing means extending radially outwardly from around the periphery of the main body, said sealing means including a sealing edge which is engageable with said sealing surface and a resiliently flexible web connecting said sealing edge to said main body, said web being movable between a sealing condition and a relaxed condition, the diameter of the sealing edge in the sealing condition being less than its diameter when the web is in the relaxed condition, said web being moved to said sealing condition when said closure operatively closes said opening, the resilience of the web material being such that said sealing edge is thereby pressed against said sealing surface.

The aforementioned web may be substantially "flat" in the sense that it provides a substantially straight line connection between the closure body and the sealing bead and thereby provides relatively high resistance to radially inward collapse of the bead. That is, the web is substantially flat between its radially inner and outer edges, but is not necessarily flat in the sense that its inner and outer edges are contained in the same plane. Indeed, it is generally preferred that the web has a slight frusto-conical configuration when in the relaxed condition.

An embodiment of the invention is described in detail in the following passages of the specification which refer to the accompanying drawings. The drawings, however, are merely illustrative of how the invention might be put into effect, so that the specific form and arrangement of the various features as shown is not to be understood as limiting on the invention.

Figure 2:
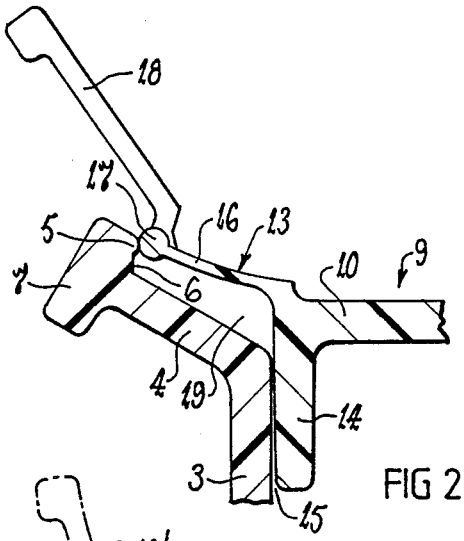
Figure 3:
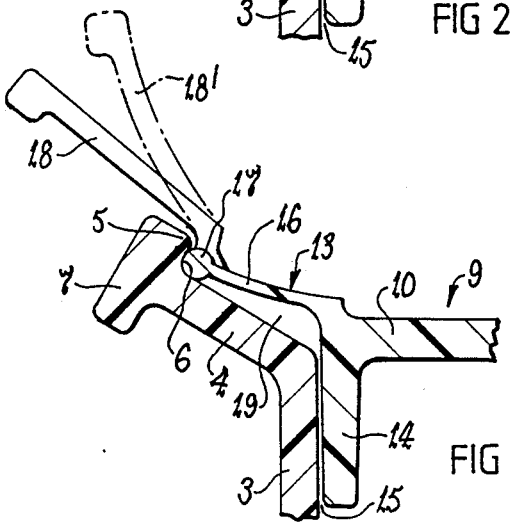
Figure 7:
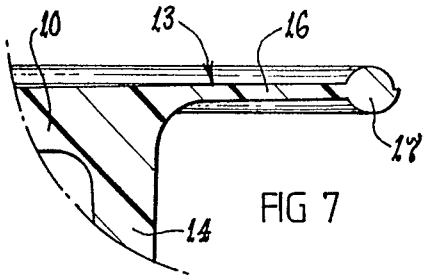
Figure 6:
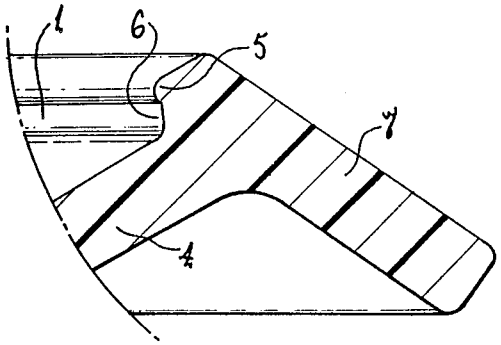
Figure 4:
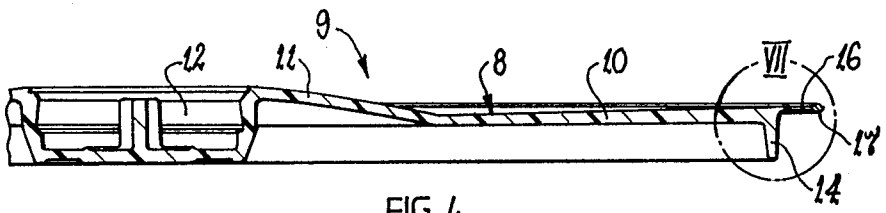
Figure 5:
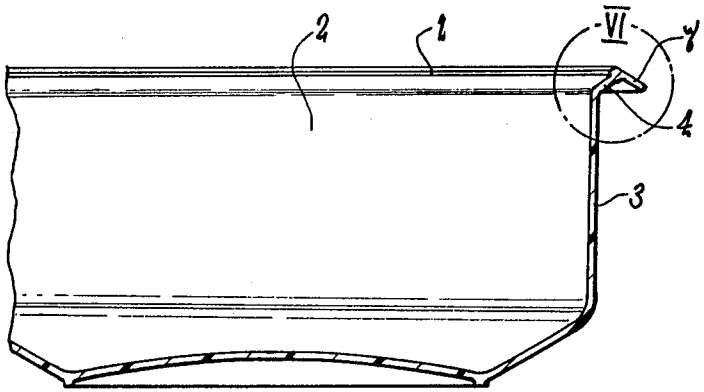
Figure 8:
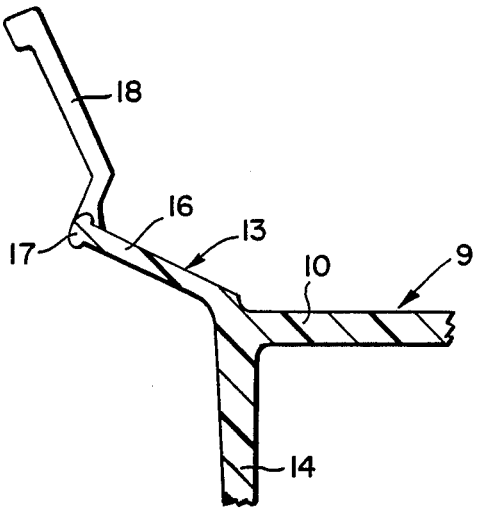

In the drawings:

FIGS. 1 to 3 show a cross-sectional view through an edge region of a container with a closure therefor in accordance with the invention, the closure being shown in disengaged, partially engaged and engaged positions in FIGS. 1, 2 and 3 respectively, FIG. 4 shows a cross-sectional side view through a closure according to the invention, FIG. 5 shows a cross-sectional side view through the type of container with which the closure of FIG. 4 is arranged to engage, FIG. 6 shows a detailed cross-sectional side view through the edge region of the container of FIG. 5, FIG. 7 shows a detailed cross-sectional side view through the edge region of the closure of FIG. 4, and FIG. 8 shows a cross-sectional side view of another embodiment of the closure according to the invention.

The example closure shown in the drawings is particularly suited for use with a relatively wide mouth container of the kind as might be used in a kitchen for storing and/or cooking food. Such a container might be constructed of any suitable material and may be of any suitable form. For the purposes of the following discussion, however, it will be assumed that the container is of substantially cylindrical form.

Since a closure according to the invention is of the internal sealing kind, the container has an internal closure engaging surface 1 located at or adjacent the top of the container side wall. That surface 1 will be hereinafter referred to as the sealing surface of the container. Referring to FIGS. 5 and 6 the internal sealing surface 1 of the container is located above and outwardly of the open mouth 2 of the container. That open mouth 2 is formed at the upper end of the cylindrical side wall 3 of the container, and a skirt section 4 extends at an angle upwardly and outwardly from the mouth 2 as shown. The sealing surface 1 is provided at the radially outer end portion of the skirt section 4. It is to be understood, however, that the container sealing surface 1 could be at or below the open mouth 2, or if it is above that open mouth, it need not be disposed radially outwardly as shown. Furthermore, the skirt section 4 may take a form other than that shown.

The container sealing surface 1 may be flat as shown, or it may be curved or otherwise contoured. In the particular arrangement shown, the surface 1 slopes upwardly and inwardly at a slight angle so as to improve the effectiveness of the closure seal as hereinafter described.

Retaining means is preferably provided to ensure that a closure is retained in an operative position on the container under normal conditions of use. In the construction shown, that retaining means includes an inwardly projecting flange or lip 5 which is located at the upper end of the internal sealing surface 1. The arrangement is such that a relatively shallow seal locating groove 6 is formed between the lip 5 and the skirt section 4 and has the sealing surface 1 as its base.

Means may be provided at or near the top of the container side wall 3 to facilitate lifting and general handling of the container. In the construction shown, such handling means is formed by an outwardly and downwardly extending flange 7, but other arrangements are possible. It may be convenient to extend the inner edge of the flange 7 to form the lip 5 as shown. It is preferred, but not essential, that the lip 5 be continuous, and the flange 7 may or may not be continuous.

The closure 9 shown in FIGS. 4 and 7 of the drawings has a main body 8 of generally disc or plate-like form. If desired, that body 8 may have an outer annular section 10 which is substantially flat as shown, and a central section 11 which is of shallow frusto-conical form and has an open top cavity 12 at its centre. The central section 11 preferably slopes outwardly and downwardly from the cavity 12 as shown, and the cavity 12 may contain a pressure relief valve (not shown). Other forms of closure body may be adopted, and provision for a pressure relief valve is clearly optional.

It is preferred that the closure includes locating means to facilitate location within the container mouth 2. In the example shown, that locating means is formed by a shallow from the outer edge portion of the main body 8. That wall 14 is preferably dimensioned to fit within the container side wall 3 with clearance 15 as shown. The extent of that clearance need not be large. Indeed, the contrary is preferred for a reason hereinafter made clear. It is clearly not essential for the closure to have a wall 14 to facilitate location of the closure within the container mouth 2. Different types of locating means such as guide ribs or the like are possible, and in certain circumstances it may be preferable to omit the locating means all together.

The closure sealing means preferably includes a flexible annular rim 13 which is provided around and extends radially outwards from the outer edge of the closure main body 8. That rim 13 includes a flexible web 16 which terminates at its outer edge in a circumferential bead 17, and that bead serves to strengthen or rigidify the rim 13. As shown, the bead 17 may be of substantially circular shape in transverse cross section. The arrangement is such that in the normal relaxed condition of the closure as shown by FIG. 1, the maximum diameter of the sealing bead 17 is greater than the maximum diameter of the container sealing surface 1. That is, the relative dimensions of the bead 17 and the surface 1 are such that the web 16 must be distorted or deflected to permit engagement and separation of the sealing means and the cooperable container sealing surface.

FIG. 1 of the drawings indicates that the web 16 has no angular inclination when in the relaxed condition. An alternative configuration is that, when relaxed, the web 16 extends upwardly and outwardly at a slight angle so as to have something of a frusto-conical configuration. The angle of slope may be quite small.

Release means may be provided on the closure to facilitate separation of the closure from the container. In the construction shown, that release means includes at least one tab 18 which extends upwardly and outwardly from the sealing bead 17 so as to be convenient for manual engagement.

FIGS. 1 to 3 show the manner of operation of the closure. In FIG. 1, the closure is in its normal relaxed condition and is being moved downwardly into the container mouth 2. The web 16 may be substantially flat at that time, or it may have a very slight slope outwards and upwards, so that the sealing bead 17 has its maximum diameter or lateral extent and, as shown, cannot pass through the internal diameter of the container lip 5. Because of the interference caused by the lip 5, the web 16 must deflect as shown in FIG. 2 to allow sufficient reduction of the diameter of the bead 17 to permit downward passage of the closure towards its operative position as shown in FIG. 3.

When the bead 17 is located below the container lip 5, the web 16 is able to relax to some extent and thereby cause the bead 17 to move outwardly into engagement against the container sealing surface 1. That is, the web 16 has the property of elastic memory such that it will tend to return to its undeformed configuration when the conditions which cause the deformation are relaxed or removed. In the arrangement shown, the dimensions of the surface 1 are such that complete relaxation of the web 16 is not possible under the conditions shown in FIG. 3. Thus, in the engaged condition as shown in FIG. 3 and the web 16 is placed under compressive stress between the sealing surface 1 and the main body 8 tending to press the bead 17 firmly against the sealing surface 1 and thereby achieve a fluid tight seal.

It is a feature of the arrangement shown that the web 16 slopes outwardly and upwardly when the closure is operative as shown in FIG. 3. As a consequence of that configuration of the web 16, any increase in the internal pressure of the container will tend to cause the closure to seal more firmly against the container sealing surface 1. That is, such pressure will tend to move the closure body 8 upwards and that will in turn tend to flatten the web 16 and thereby increase its diameter. The slight slope of the surface 1 as previously described adds to the effectiveness of the sealing engagement between the closure and container.

The closure body 8 is preferably relatively inflexible so as to ensure that at least the major deflection or distortion of the closure occurs at the web 16 under normal conditions of use. Furthermore, it is not necessary to initially have a tight sealing engagement between the bead 17 and the container surface 1 if the container is to be used for cooking purposes, since internal pressure generated within the container will improve the seal as described above.

A clearance space 19 preferably exists between the web 16 of the closure and the container skirt section 4 so as to enable sufficient deflection or distortion of the web 16 for seal engagement and release purposes. Release of the seal can be effected by pulling up on the tab 18 to the position shown by dotted lines 18' and then progressively peeling the closure from the container in a circumferential direction.

The sealing surface and the closure will preferably be of circular form in plan view, but clearly it is not essential that the form be circular. Oval shaped containers and closures are envisaged, and even square shapes with rounded corners are possible. The closure can be made of any suitable material, but polypropylene, polyethylene, or other polyolefin material is generally preferred.

The aforementioned clearance 15 may serve to capture moisture which, in a refrigerated environment, will freeze and thereby add to the sealing effectiveness of the closure.

It will be apparent from the foregoing description that a closure according to the invention has several advantages over the prior art. The closure is of relatively simple construction Yet has a particularly effective sealing arrangement. Furthermore, application and removal of the closure is not a complicated procedure. A container and closure combination as described has the particular advantage of being usable with equal effectiveness in a variety of different conditions. Furthermore, the absence of an upwardly projecting hand engageable knob on the closure enables such combinations to be stacked one upon the other, particularly if the base of the container has a shallow cavity to receive the central frusto-conical portion of the closure as described.

Finally, it is to be understood that various alterations, modifications and/or additions may be introduced into the constructions and arrangements of parts previously described without departing from the spirit or ambit of the invention as defined by the appended claims.

Having now described our invention what we claim as new and desire to secure by Letters Patent is:

1. A closure for the open mouth of a container having an internal sealing surface which defines or is adjacent to said open mouth and against which said closure engages to close said open mouth, said closure comprising, a main body, sealing means extending radially outwardly from around the periphery of the main body, said sealing means including a sealing edge which is engageable with said sealing surface and a resiliently flexible web connecting said sealing edge to said main body, said web being movable between a sealing condition and a relaxed condition, a diameter of the sealing edge in the sealing condition being less than a diameter of the sealing edge when the web is in the relaxed condition, said web being movable to said sealing condition when said closure operatively closes said open mouth, the resilience of the web material being such that said sealing edge is thereby pressed against said sealing surface, said main body being considerably less flexible than said web, said main body carrying a locating means on the operatively inner side thereof to facilitate locating said closure relative to said open mouth, said location means comprising a guide wall connected to the lower side of said main body around the radially outer edge portion thereof, said guide wall projecting into said container when said closure is in said sealing condition.

2. A closure according to claim 1 wherein said web is of truncated conical form diverging in an upward direction in said relaxed condition, said sealing edge being defined around the upper and outer edge of the web.

3. A closure according to claim 1 wherein, said web is inclined upwardly and outwardly from said main body when said sealing means is in said engaged condition such that an increase in pressure within said container in use will tend to increase the force with which said edge is pressed against said sealing surface.

4. A closure according to claim 1 wherein said web is integral with both said main body and said sealing edge.

5. A closure according to claim 1 wherein said sealing edge takes the form of a continuous bead extending around the periphery of said web, and said bead is substantially circular in transverse cross-section.

6. A closure according to claim 1 wherein in the relaxed condition of said sealing means the web is flat between its radially inner and radially outer edges.

7. A closure according to claim 6 wherein in said relaxed condition said web has a slight frusto-conical configuration.

8. A closure according to claim 1 wherein a release tab is connected to the radially outer edge portion of said sealing means to enable said sealing means to be pulled into a distorted condition for disengaging said sealing edge from said sealing surface.

9. A closure according to claim 1 wherein said sealing surface tapers converging in an upward direction.

10. A closure according to claim 1 wherein said guide wall is a continuous cylindrical wall.

11. A closure and container combination, said container having an open mouth, an annular groove surrounding said open mouth, an internal sealing surface being formed by a base portion of said groove, and a retaining lip being formed by an operatively upper portion of said groove, and said closure comprising a main body, sealing means extending radially outwardly from around the periphery of said main body, said sealing means including a sealing edge which is engageable with said sealing surface and a resiliently flexible web connecting said sealing edge to said main body, said web being movable between a sealing condition and a relaxed condition, a diameter of the sealing edge in the sealing condition being less than a diameter of the sealing edge when the web is in the relaxed condition, said web being movable to said sealing condition when said closure operatively closes said open mouth, the resilience of the web material being such that said sealing edge is thereby pressed against said sealing surface, said sealing edge of said closure being adapted to engage and seal with said sealing surface, said lip serving to retain said sealing edge against said sealing surface when said sealing means is in said sealing condition.

12. A combination according to claim 11 wherein said container has a substantially cylindrical side wall, and a skirt section formed on the upper edge of said side wall, said skirt section extending at an angle upwardly and outwardly from said upper edge, said sealing surface being formed at the radially outer portion of said skirt section.

13. A combination according to claim 11 wherein said container has a substantially cylindrical side wall, and a skirt section formed on the upper edge of said side wall, said skirt section extending at an angle upwardly and outwardly from said upper edge, said sealing surface being formed at the radially outer end portion of said skirt section.

* * * * *